US005502860A

United States Patent [19]

Franke

[11] Patent Number: 5,502,860

[45] Date of Patent: Apr. 2, 1996

[54] HAIRBRUSH WITH TORQUE RESISTANT HEAD

[76] Inventor: John Franke, 1200 Garin Ave., Hayward, Calif. 94544

[21] Appl. No.: 239,505

[22] Filed: May 9, 1994

[51] Int. Cl.[6] ..... A46B 3/70; A46B 7/02

[52] U.S. Cl. ..... 15/160; 15/172; 15/145; 15/176.1; 15/176.6

[58] Field of Search ..... 15/160, 172, 201, 15/144.1, 105, 143.1, 398, 399, 400, 401, 184, 185, 171, 145, 176.1; 132/135, 151

[56] References Cited

U.S. PATENT DOCUMENTS

| | | | |
|---|---|---|---|
| 2,688,971 | 9/1954 | Daniels et al. | 15/105 |
| 3,340,556 | 9/1967 | Allen | 15/144.1 |
| 3,835,869 | 9/1974 | Newman et al. | 15/400 |
| 3,843,990 | 10/1974 | Lardenois | 15/160 |
| 3,965,527 | 6/1976 | George | 15/400 |
| 3,968,536 | 7/1976 | Leighton et al. | 15/172 |
| 4,656,684 | 4/1987 | Jewett | 15/187 |
| 5,333,345 | 8/1994 | O'Donnell | 15/144.1 |

FOREIGN PATENT DOCUMENTS

| | | | |
|---|---|---|---|
| 2927887 | 1/1981 | Germany | 15/401 |
| 1158936 | 7/1969 | United Kingdom | 15/201 |

*Primary Examiner*—Gary K. Graham

*Attorney, Agent, or Firm*—John D. Gugliotta

[57] ABSTRACT

A hairbrush device includes a limited-excursion, rotating brush head with continuously variable rotational resistance, thereby minimizing tugging-related damage while brushing hair using a simple stroking motion. Thick or tangled hair engages the bristles causing the brush head to rotate from a resting position. A spring means provides increasing resistance in concert with increased rotation of the brush head. When the bristles are removed from the hair, the spring means returns the brush head to its resting position for the next stroke. Preferably, the spring means includes a brush connector releasingly affixed to interchangeable brush heads and releasingly and rotatingly affixed to interchangeable handles. An effective length limiter grips a flat torsion bar affixed to the connector and a shank extends from the gasket axially through the brush handle. A conventional spring release and track within the handle allow the limiter to be moved longitudinally along the torsion bar to increase or decrease resistance. Also preferably, the handle and connector provide an integral brush head rotation limiting means, thereby preventing over-rotation and resultant damage. Closed or open-ended handles provide for singular hairbrush, comb or pick, as well as curling iron, hair dryer and similar conventional hairbrush type applications. Bidirectional operation allows left and right handed users to wave through hair and to impose ratting effects through backbrushing.

8 Claims, 5 Drawing Sheets

HAIRBRUSH WITH TORQUE RESISTANT HEAD

BACKGROUND OF THE INVENTION

1. Field of Invention

This invention relates generally to hair maintenance and styling devices and in particular to rotating head hairbrushes, combs and picks as stand-alone, combination and attachment type devices.

2. Description of Prior Art

Hairbrushes with stationary brush heads are well known as are rotatable head hair brushes. Such devices have been used alone, provided with heating elements as curling irons or connected to hair dryers. Holley, U.S. Pat. No. 4,197,608 and Jewett, U.S. Pat. No. 4,656,684 respectively.

The bristles of stationary head hairbrushes often grab thick and\or tangled hair. Since the brush is a stationary extension of the handle, a conventional brushing motion causes tugging at the hair and eventually causes hair breakage and splitting. So hair care professionals have developed a special wrist movement to provide a combination of brush rotation and movement with variable resistance, referred to in the hair care industry as "waving through the hair". However, this movement is difficult to master and is even more difficult to use on oneself, particularly toward the back of the head and where left or right handedness makes such movement awkard.

Many hairbrush devices, such as Fronius, U.S. Pat. No. 4,685,165, provide a separately moulded, rotatingly affixed brush head that freely rotates as the user applies a conventional brushing motion. Unfortunately, while the brush head rotates rather than tugging at the hair, the brush provides no integral counter rotational resistance. Rather the user must somehow coordinate a conventional brushing motion with one hand and, at the same time, an appropriate brush head rotation damping motion with the other hand. Thus a high degree of training and dexterity, as well as a third hand to position the hair, is required to emulate the brushing motion of hair care professionals.

Other devices such as Dorn, U.S. Pat. No. 4,314,137, add a locking mechanism such that the brush can be used switchably as either a conventional stationary brush or rotating head brush. The disadvantage is that the brush also produces the undesired effects of both stationary and rotating head brushes, be it in an alternative fashion.

Still other rotating head hairbrush devices provide a means for setting the amount of resistance applied to the brush head. A motorized blow dryer as with Schilig, U.S. Pat. No. 4,664,132, improves upon a conventional hair brush attachment by attempting such a feature. One disadvantage is that it fails to allow the user to feel changing pressure in order to adjust accordingly. A second disadvantage is that no provision is made for returning the brush head to a known resting position for consecutive strokes despite the common use of asymetrical brush heads.

A third disadvantage is that the resistance, while manually adjustable, is otherwise constant. Not only is the resistance too severe for the start of a stroke, but it does not vary appropriately throughout the stroke for working through tangles and other continuously variable hair conditions. A third disadvantage is that resistance is unidirectional, forcing often uncomfortable and inefficient positioning of the device for left or right-handed users.

Each of these designs fails to provide continuously variable resistance as a brush, comb or pick is eased through the hair, let alone resistance that varies in concert with rotation of the brush head. Resistance must increase gradually and in concert with rotation of the brush head as the bristles move through the hair in order for the user to detect and cure trouble spots through waving and repeated strokes. In addition, the resistance should vary appropriately with each stroke since hair varies from person to person, from one brushing session to another, from section to section of hair and even from stroke to stroke. For all but the most coordinated and well-trained hair care professionals, such changes must occur automatically as an intrinsic property of the hairbrush device. Additionally, a configurable overall torque curve will further minimize hair damage. The preferable hairbrush device, whether used as a conventional comb or brush, a curling iron, a blow dryer attachment or in other common forms, should also work equally well for right-handed and left-handed users.

Thus there is a need for a rotatable head hairbrush device that emulates the motion of a hair care professional in treating and styling unruly hair while requiring only a simple conventional stroking motion. A device that automatically provides increasing and easily conformable resistance or counter rotational torque in concert with the rotation of the brush head. One that performs similarly for right and left handed persons, returning the brush head to a resting position following each rotation.

SUMMARY OF THE INVENTION

This invention provides an inexpensive brush, comb or pick type device with automatically variable brush head torque. With only a simple brushing motion, the rotatable head produces a motion commensurate with that of a hair care professional. Various densities and conditions of hair are thus detangled and\or styled without damaging the hair, all with minimal effort, no special experience, knowledge, handedness or dexterity on the part of the user.

One object of the invention is to provide a rotatable head brush with an automatically increasing rotational torque commensurate with brush head rotation and a head that automatically returns to its starting position following each stroke. This not only acts to style and detangle hair while avoiding damage, but requires only a simple user motion as with a traditional non-rotating head hairbrush.

A second object of the invention is to provide a rotatable head brush with an automatically increasing rotational torque commensurate with brush head rotation wherein such torque and rotation are bidirectional. In this way both right and left-handed users can take advantage of both an essentially unidirectional stroke to produce a waving effect as well as a bidirectional, back-brushing stroke to produce a teasing effect referred to in the hair care industry as "ratting".

A third object of the invention is to provide for matching maximum torque with hair care requirements depending upon the density and condition of the hair. Hair conditions tend to vary from person to person as well as for a single person both day to day and, on a given day, from section to section of hair. Too much tension may well cause damage while too little tension fails to fulfill its intended curing purpose. Thus both automatically increasing torque and easy access to and easy adjustment of rate of torque increase are provided.

A fourth object of the invention is to provide a hairbrush that provides these features whether used as a handheld hairbrush or comb, a curling iron, a hairbrush attachment for blow dryers, an integrated hair dryer or any other conventional hairbrush type application.

These and other objects, advantages, features and benefits of the present invention will become apparent from the drawings and specification that follow.

DETAILED DESCRIPTION OF THE PREFERRED EMBODIMENT

Figure 1:
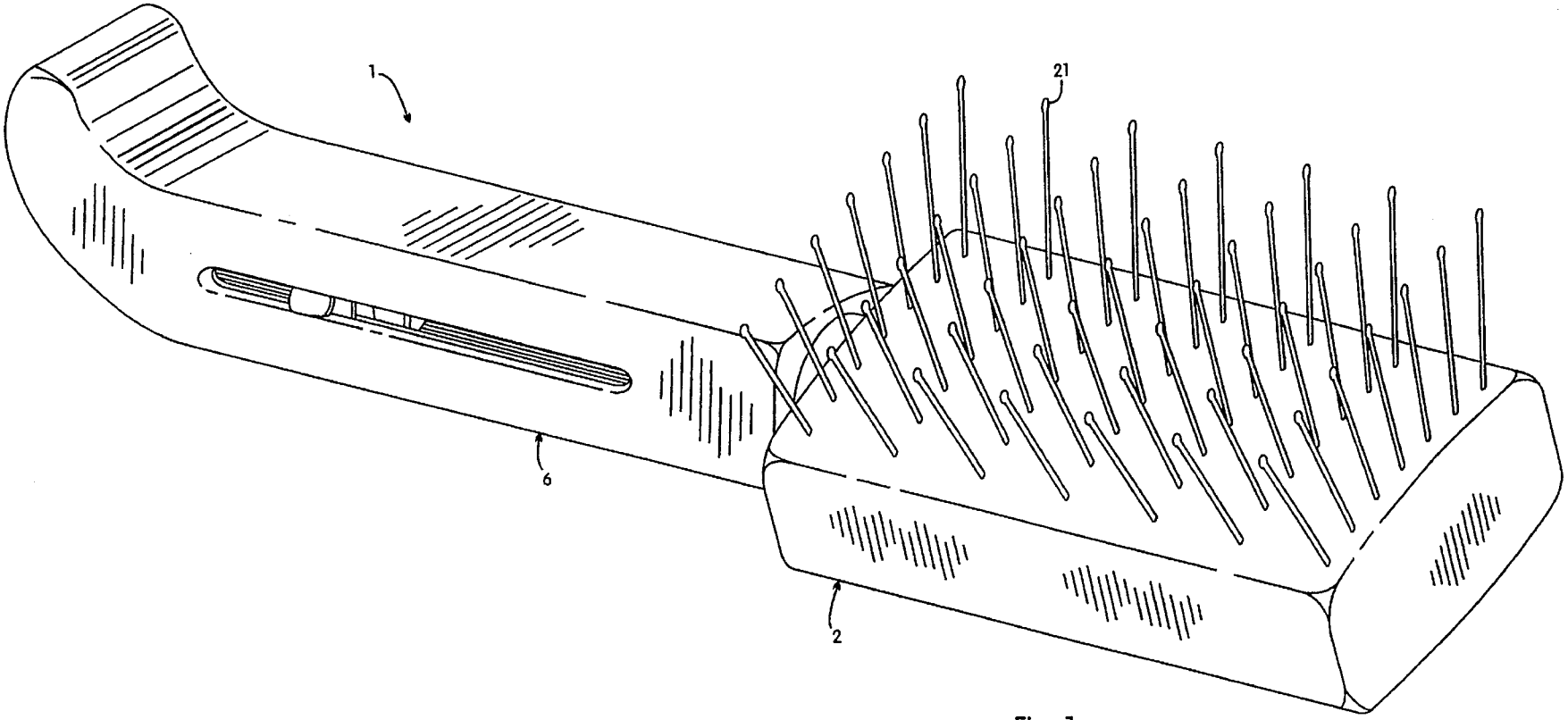
FIG. 1 is a front right perspective view of the Hairbrush With Torque-Resistant, rotatable Head showing a preferred embodiment as a conventional closed-handle hairbrush.

As shown in FIG. 1, a Hairbrush with torque-resistant, rotatable head is shown, according to the preferred embodiment of present invention, comprising a hand-held hairbrush, wherein a brush head 2 is rotatable as the handle 6 is moved in a brushing motion with the bristles 21 engaging a subject's hair. This embodiment is preferred due to the inherent ease of manufacturing and lower cost in producing a closed-channel design as compared with producing other obvious open-channel variations briefly explored below.

Figure 2:
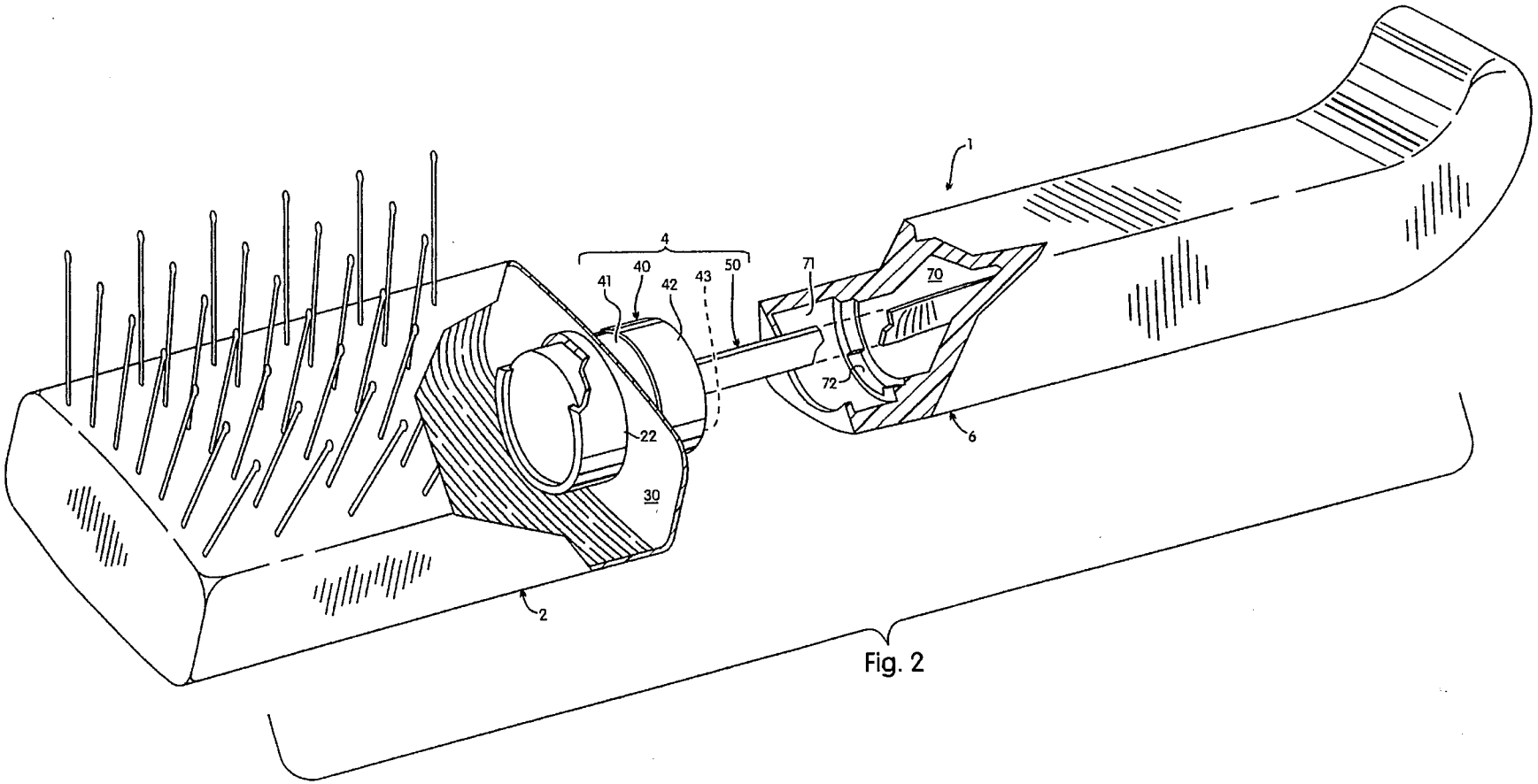
FIG. 2 is a back left perspective, partial cutaway view thereof, showing the preferred method for interconnecting the brush head, torsion assembly and handle for providing a limited excursion rotatable head.

FIG. 2 depicts further the attachment of the brush head 2 to the handle 6 via a torsion assembly 4. The torsion assembly 4 includes an integral mounting head 40 and an essentially flat, generally elongated torsion bar 50 affixed to and extending outward therefrom. The mounting head 40 is affixed to the brush head 2 as described below. Finally, an excursion limiting tab 43 extends outward from the exposed flat surface of the rotation disc 42 near the outer circumference of the rotation disc 42.

The head mounting portion 41 is received by and affixed within a brush head cavity 30 moulded into the brush head base 22. The rotation disc or handle locking portion 42 is releasingly and rotatingly inserted within a rotation portion 71 of a handle cavity 70, the handle cavity 70 forming an inner handle surface molded into the brush end of the handle 6, which handle 6 is gripped at an outer base surface 7 forward of a butt end 8. The excursion limiting tab 43 extends into a rotation channel 72, the rotation channel 72 abutting the rotation portion 71 and extending less than the full circumference of the handle 6. Rotating the brush head 2 therefore causes the mounting head 40 of the torsion assembly 4 to rotate within the rotation portion 71 of the handle cavity 70 to the circumferential extent of the rotation channel 72 without rotation of the handle 6.

Figure 3A:
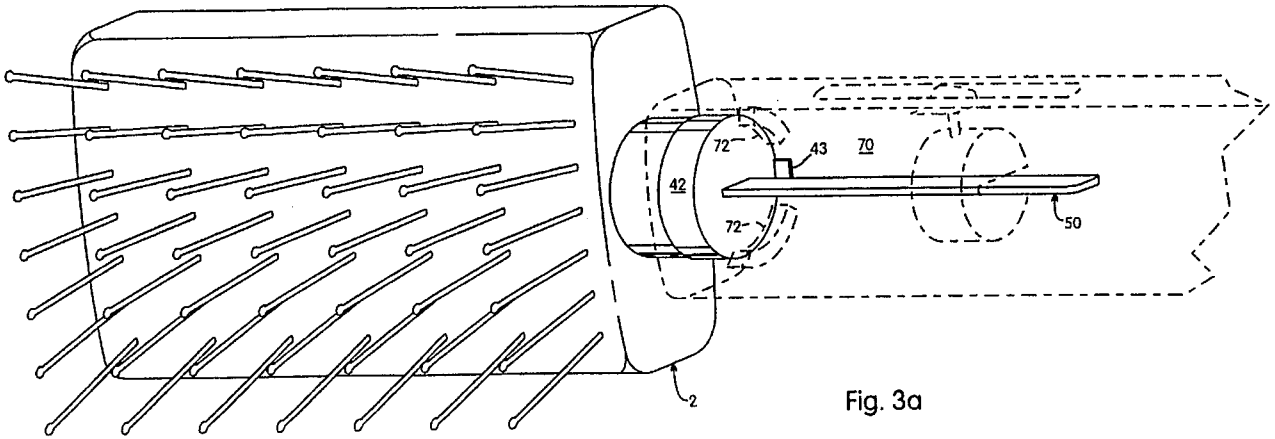
FIGS. 3*a* is a top perspective view thereof showing how a torsion bar is gripped at either end in an alignment that provides for similar limited excursion counter rotational torque as the brush head is rotated either clockwise or counter-clockwise.
Figure 3B:
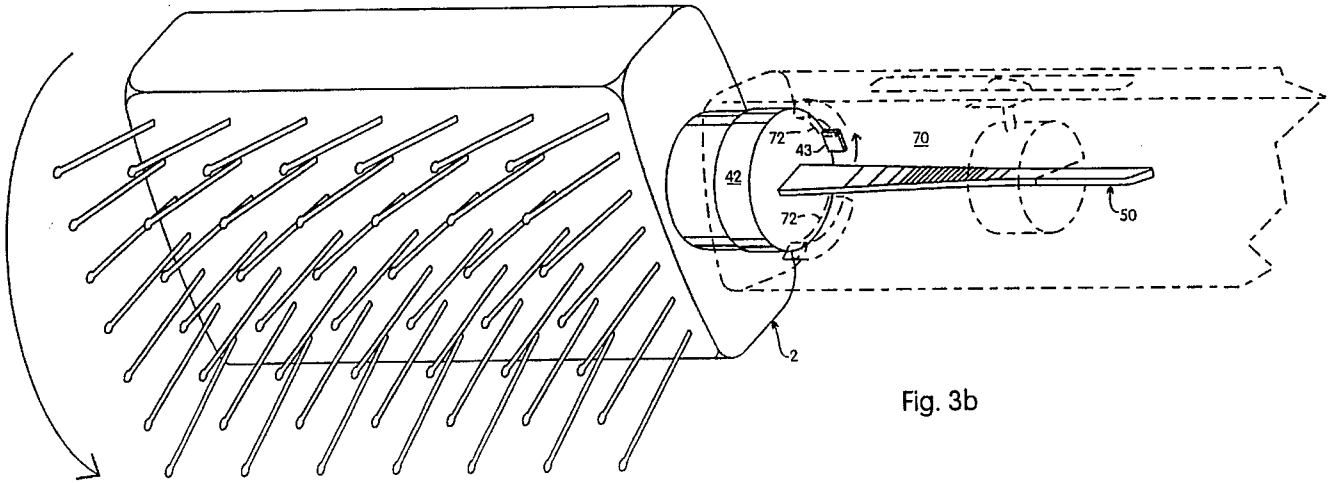
FIG. 3*b* is a top perspective view showing how rotation of the brush head twists the torsion bar between its affixed ends, moving an excursion limiting tab within an excursion channel.
Figure 6:
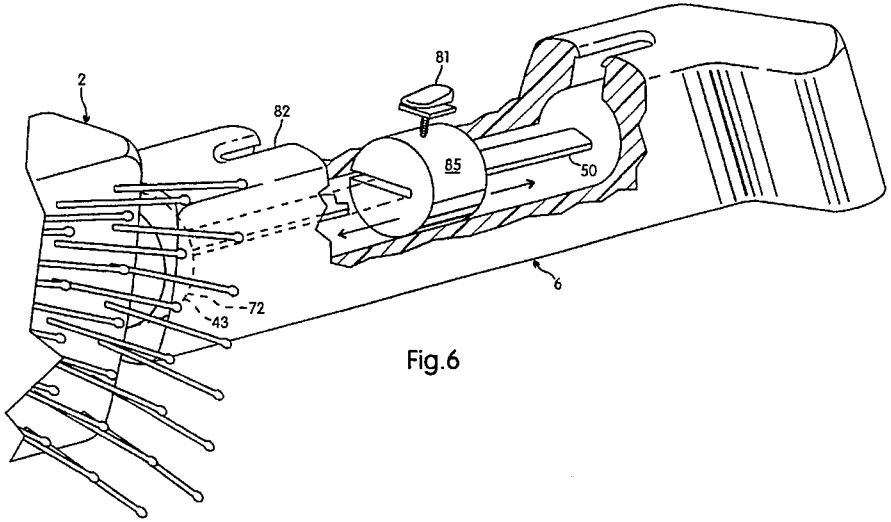
FIG. 6 is a top perspective view showing the means for increasing or decreasing the relative amount of counter torque provided commensurate with brush head rotation.

FIG. 3*a*, FIG. 3*b*, and FIG. 6 show how an increasing counter torque is produced commensurate with and in opposition to the rotation of the brush head 2, further acting to return the brush head 2 to a resting position following removal of the rotational force. The torsion bar 50 is fixed at one end to the rotation disc 42, and is generally elongated in order to insert into a receiving slot 75 formed in a maximizing disc 85, said maximizing disc 85 being inserted into the handle cavity 70. Rotation of the brush head 2 causes the essentially flat torsion bar 50 to twist, producing an increasing counter torque. When the rotational force is removed, recoiling of the torsion bar 50 is sufficient to return the brush head 2 to its resting position. The orientation of the torsion bar 50 is such that the resting position of the brush head 2 is centered about the rotation channel 72, thereby allowing for both right and left handed use.

Figure 4A:
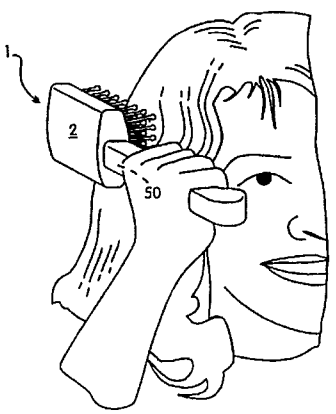
FIGS. 4*a*, 4*b* and 4*c* show how a conventional brushing motion causes the brush head to rotate axially and then return to a resting position following each stroke.
Figure 4B:
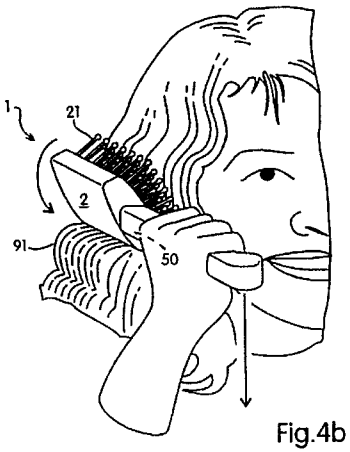
Figure 4C:
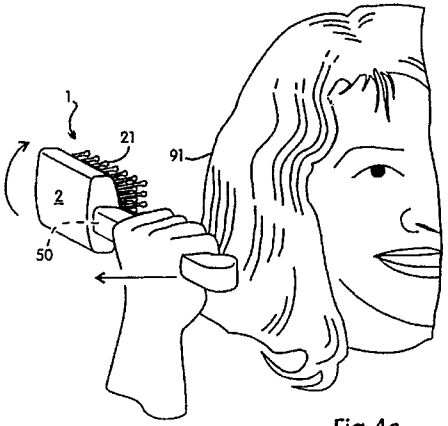
Figure 5A:
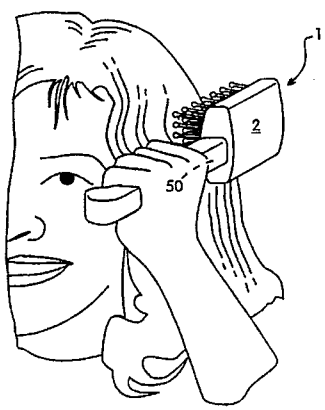
FIGS. 5*a*, 5*b* and 5*c* show how the same conventional brushing motion results in similar brush head axial rotation regardless of rotation direction and thereby regardless of left or right handed use.
Figure 5B:
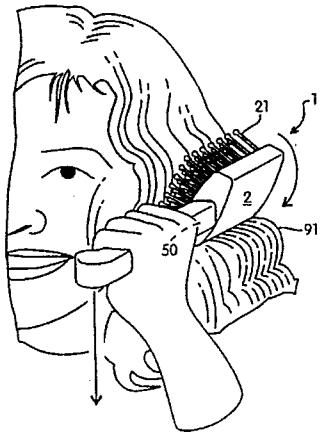
Figure 5C:
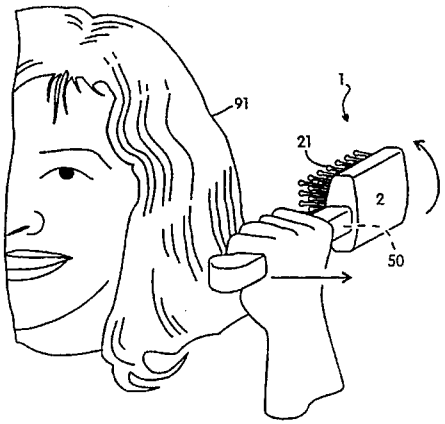

FIGS. 4*a* through 4*c* and 5*a* through 5*c* show how centering the resting position of the brush head 2 within the rotation channel 72 provides equivalent bi-directional rotation capability whereby the Hairbrush 1 may be used similarly by right handed and left handed users. The brush head 2 is held in a resting position through resistance provided by the mass of the anchored torsion bar 50 (FIGS. 4*a* and 5*a*). As the handle 2 is moved (typically) downward and the bristles 21 are gripped by the hair 91, the brush head 2 rotates. This rotation acts to twist the torsion rod 50, producing increasing counter torque and providing increasing resistance to the brush head 2 (FIGS. 4*b* and 5*b*). When the bristles 21 are removed from the hair 91, recoiling of the torsion rod 50 causes the brush head 2 to return to its initial resting position (FIGS. 4*c* and 5*c*) and readied for further brush strokes.

FIG. 6 shows how maximum counter torque is easily adjusted as needed either prior to or throughout the brushing process to ease tangles, handle varying hair thickness or to resolve similar hair brushing situations. A conventional spring-loaded release button 81 and track 82 configuration recessed longitudinally within the handle 6 is used to slideably move a slotted maximizing disc or torsion bar stabilizer 85 that surrounds the torsion bar 50. As the maximizing disc 85 is moved toward the brush head 2, the torsion bar 50 is effectively shortened. This produces a sharper increase in and greater maximum available counter torque as the brush head 2 rotates. Moving the maximizing disc 85 away from the brush head 2 effectively lengthens the torsion bar 50. This produces a lesser increase in and a lesser maximum counter torque as the brush head 2 is rotated within the range allowed by the excursion limiting tab 43 and the rotation channel 72 length.

While the above description contains many specifities, these should not be construed as limitations on the scope of the invention, but rather as an example of the preferred embodiment thereof. Many other variations are possible.

One example is that a semi-rotating head hairbrush with increasing counter-rotational torque serves the purposes already noted utilizing essentially the same design whether used as a conventional hairbrush, comb, pick, attachment (FIG. 6) or in other forms. Simply moulding longitudinal air holes through the mounting head 40 of the torsion assembly 4 and molding the handle 6 to be received by and permit air flow from a blow dryer is one such variation. The same result may also be achieved using a conventionally spoked mounting head, whether as an attachment (FIG. 6) or as a blow dryer with an integral hairbrush 1. Adding a heating element to the brush head allows the very same Hairbrush 1 to be used for safer hair curling as compared with a conventional curling iron.

Figure 7:
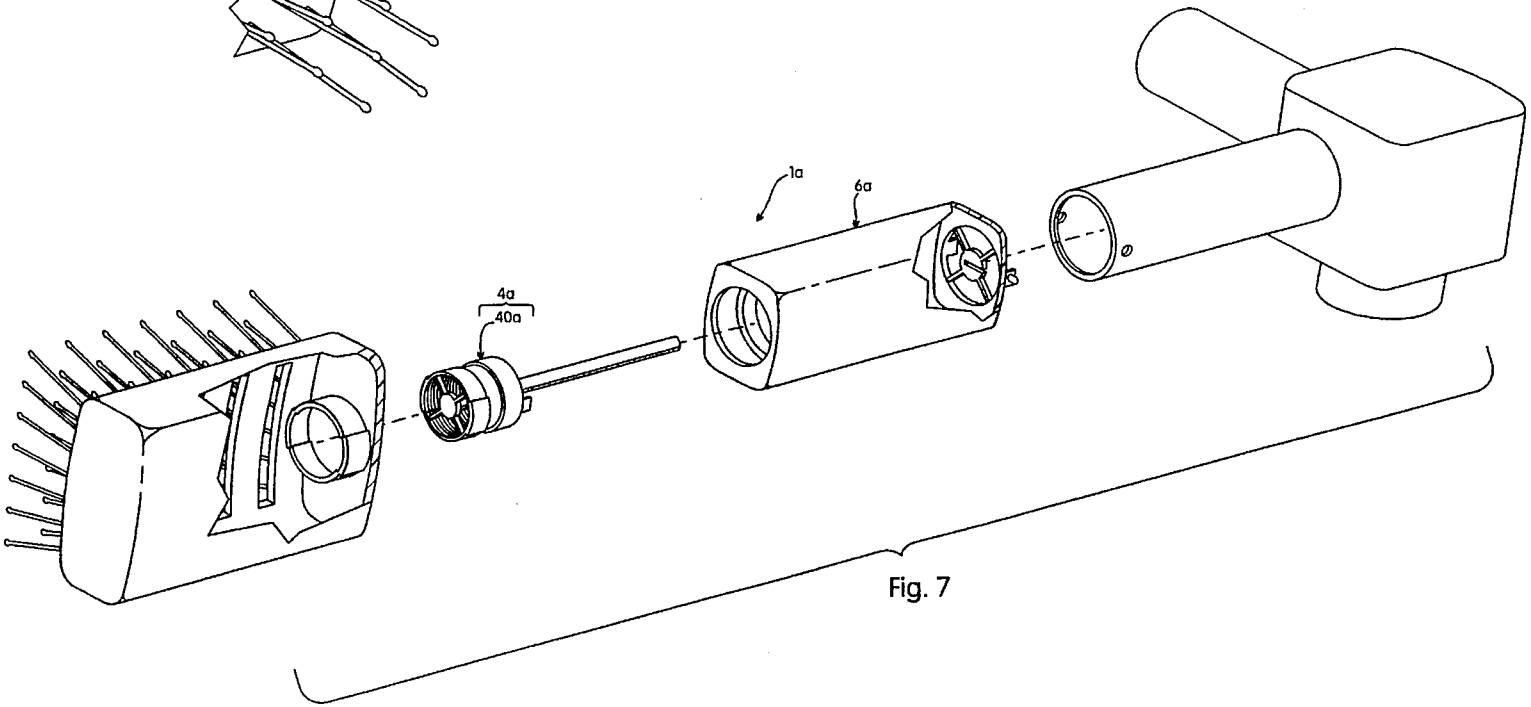
FIG. 7 is a back perspective view of the Hairbrush With Torque-Resistant, Rotatable Head showing an alternate embodiment as an open-handle hairbrush attachment for a hair dryer.

A second example is that the three primary functional parts of the Hairbrush 1, the brush head 2, torsion assembly 4 and handle 6, can be assembled as one or three separable parts in addition to the simple and inexpensive two-part variation of the preferred embodiment. Numerous conventional methods allow releaseable connection of devices in a non-rotational manner. FIG. 7, for example, shows the use of a conventional spring-locked, peg-and-hole design for connecting an open-ended handle 6 to a conventional hair dryer and a broken pressure fit ring design for connecting an open-ended torsion assembly 4 to the brush head 2.

A third example is that the torsion bar 50, while an inexpensive method, is just one of numerous conventional spring means for providing appropriate counter rotational torque. Conventional laterally-mounted or circumferentially mounted spring means perform in a similar manner to produce similar torque, but at higher cost. The maximum torque adjustment would of course be adjusted in a consistant conventional manner.

A fourth example is that the brush head 2, handle 6 or both are clearly interchangeably connectable in any of the above variations. In the preferred embodiment, changing the brush head 2, which is often necessary during one or more hair grooming sessions, is a simple matter of pulling the pressure fit torsion assembly rotation disk 42 from the rotation portion 71 of the handle cavity 70. A three separable part variation as in the third example above allows similar separation but without the need for removing a permanently affixed torsion assembly 4 along with the brush head 2. The specific appearance and interconnect methods of the brush head 2, torsion assembly 4 and handle 6 of the preferred embodiment are thus not intended as exclusive.

FIG. 7 further shows that torque curve adjustability, while preferred, adds additional manufacturing expense that can be avoided through the use of a stationary vented or unvented torsion bar 50 accepting ring with receiving slot configuration.

Other variations are, of course, also anticipated by the invention.

I claim:

1. A Hairbrush with Torque-Resistant, Rotatable Head, said hairbrush comprising:

a brush head having a brush head base;

a plurality of bristles attached to said brush head for engaging a subject's hair during hair care and styling;

an elongated handle having a brush end, a butt end, and an outer base surface;

interlocking means for interlocking together said brush head at said brush head base and said handle at said brush end in a rotatable manner about an axis oriented longitudinally with respect to said handle;

integral torque means for producing increasing resistance to and commensurate with increasing rotation of said brush head with respect to said handle; and torque adjustment means for increasing and reducing resistance produced by said torque means relative to rotational position of said brush head.

2. A Hairbrush with Torque-Resistant, Rotatable Head comprising:

an elongated brush head defining a generally hollow brush head cavity, and said brush head having an outer surface and a brush head base, said brush head base being generally cylindrical and penetrating into said hollow brush head cavity;

a plurality of bristles, said bristles affixed to said outer surface of said brush head;

an elongated hollow handle having a brush end and a butt end, said handle also having an inner handle surface and an outer handle surface, said inner handle surface defining a rotation portion proximate to said brush end;

torque means enclosed within said handle and in physical communication with both said handle and said brush head for producing increased resistance to and commensurate with increasing rotation of said brush head with respect to said handle, wherein said torque means further comprises an integral, generally enlongated, essentially flat torsion bar having a first end and a second end with said first end affixed to said brush head, and a slidable maximizing disc, said maximizing disc having a slot, said slot receiving said second end of said torsion bar, and said maximizing disc being non-rotatably affixed to said inner handle surface of said handle proximate to said butt end; and interlocking means for interlocking together said brush head and said brush handle in a rotatable manner about an axis oriented longitudinally with respect to said handle.

3. A Hairbrush with Torque-Resistant, Rotatable Head comprising:

an elongated brush head having a hairbrush end and a base, said base having an outer base surface and an inner base surface, said inner base surface defining an essentially cylindrical base cavity, said elongated brush head also having bristles affixed to said brush head and oriented for engaging a subject'hair during hair care and styling;

an elongated brush handle having a brush end and a butt end, also having an inner handle surface and an outer handle surface, the inner handle surface defining a rotation portion proximate to said brush end and a rotation limiting channel abutting the rotation portion, said brush handle also having an integral torsion bar stabilizer non-rotatingly affixed to said inner surface of said brush handle proximate to said butt end;

interlocking means having a base end and a handle end, said interlocking means including an essentially disc shaped head mounting portion at said base end, and an essentially disc shaped handle locking portion at said handle end, said head mounting portion being fixedly secured to said base of said brush head, said handle locking portion being interchangeably and rotatably connected by said rotation portion of said brush handle, for interlocking together said brush head and said brush handle in a rotatable manner about an axis oriented longitudinally with respect to said brush handle; and a torsion bar extending longitudinally from said handle end of said interlocking means and received by the torsion bar stabilizer such that rotation of said brush head causes said torsion bar to twist and such twisting produces an increasing torque counter to sch rotation, the counter torque being sufficient to return said brush head to its original resting position when a force causing such rotation is removed.

4. A Hairbrush with Torque-Resistant, Rotatable Head as defined in claim 3, wherein said outer handle surface further defines a longitudinal torque adjustment track and further comprises a torque adjustment control and a torque adjustment limiter, the torque adjustment control being affixed such that it moves releasingly and slidably within the torque adjustment track, the torque adjustment limiter being affixed to the torque adjustment control such that it causes the torque adjustment limiter to move slidably along said torsion bar, increasing and decreasing effective torsion bar length, such that counter rotational torque can be adjusted.

5. A Hairbrush with Torque-Resistant, Rotatable Head as defined in claims 3 or 4, wherein said handle is molded for use as a hand held grooming implement.

6. A Hairbrush as defined in claims 3 or 4, wherein said brush head, said handle and said interlocking means are each essentially tubular and in fluid communication with each other and vented such that forced air can flow from said butt end of said handle through said brush head, said butt end of said handle further comprising a blow drier attachment means for interchangeably affixing said hairbrush to a blow dryer.

7. A Hairbrush with Torque-Resistant, Rotatable Head as defined in claims 3 or 4, wherein said brush head, said handle and said interlocking means are essentially tubular and in fluid communication with each other and vented such that forced air can flow from said butt end of said handle through said brush head, said butt end of said handle being further formed as an integral molded extension of a blow dryer.

8. A Hairbrush with Torque-Resistant, Rotatably Head as defined in claim 3, wherein said torsion bar and said torsion bar stabilizer of said brush handle are oriented such that the rotation limiting tab of said interlocking means can move essentially equidistantly from an unbiased position in opposite directions of rotation within the rotation limiting channel, thereby providing essentially equivalent operation for both left and right handed users.

* * * * *